US007714879B2

(12) United States Patent
Asai et al.

(10) Patent No.: US 7,714,879 B2
(45) Date of Patent: May 11, 2010

(54) CHARACTER/GRAPHIC DISPLAY APPARATUS, CHARACTER/GRAPHIC DISPLAY METHOD, PROGRAM, AND RECORDING MEDIUM

(75) Inventors: Yoshimi Asai, Osaka (JP); Noriyuki Koyama, Kyoto (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 536 days.

(21) Appl. No.: 10/558,293

(22) PCT Filed: May 27, 2004

(86) PCT No.: PCT/JP2004/007275

§ 371 (c)(1),
(2), (4) Date: Aug. 18, 2006

(87) PCT Pub. No.: WO2004/107310

PCT Pub. Date: Dec. 9, 2004

(65) Prior Publication Data

US 2007/0070089 A1 Mar. 29, 2007

(30) Foreign Application Priority Data

May 29, 2003 (JP) ..... 2003-153322

(51) Int. Cl.
*G09G 5/00* (2006.01)

(52) U.S. Cl. ..... 345/660; 345/467; 345/619; 715/788

(58) Field of Classification Search ..... 345/660, 345/472.1, 467; 715/788
See application file for complete search history.

(56) References Cited

U.S. PATENT DOCUMENTS

| | | | | | |
|---|---|---|---|---|---|
| 4,283,724 | A | * | 8/1981 | Edwards | 345/26 |
| 4,511,267 | A | | 4/1985 | Pokorny et al. | |
| 4,621,340 | A | | 11/1986 | Pokorny et al. | |
| 4,642,790 | A | * | 2/1987 | Minshull et al. | 715/784 |
| 4,670,841 | A | * | 6/1987 | Kostopoulos | 715/273 |
| 5,001,697 | A | * | 3/1991 | Torres | 715/202 |
| 5,241,653 | A | * | 8/1993 | Collins et al. | 345/668 |
| 5,347,624 | A | * | 9/1994 | Takanashi et al. | 345/641 |

(Continued)

FOREIGN PATENT DOCUMENTS

EP 1 308 924 A2 5/2003

(Continued)

*Primary Examiner*—M Good Johnson
(74) *Attorney, Agent, or Firm*—Birch, Stewart, Kolasch & Birch, LLP

(57) ABSTRACT

The size of each of the plurality of characters or graphics is modified while the size of each of the plurality of virtual areas included in the display area is maintained, so that the visual recognizability (ease of reading, or ease of recognition through reading) of characters or graphics is improved without changing the layout thereof. A character/graphic display apparatus of the present invention includes a display device including a display area for displaying a plurality of characters or graphics; and a control section for controlling the display device. The display area includes a plurality of virtual areas. The control section modifies the size of each of the plurality of characters or graphics while maintaining the size of each virtual area included in the display area; and controls the display device to display each of the plurality of characters or graphics having the modified size in the respective virtual area.

11 Claims, 22 Drawing Sheets

400

U.S. PATENT DOCUMENTS

| | | | | |
|---|---|---|---|---|
| 5,544,288 | A * | 8/1996 | Morgan et al. | 715/801 |
| 5,751,283 | A * | 5/1998 | Smith | 715/798 |
| 5,886,694 | A * | 3/1999 | Breinberg et al. | 715/788 |
| 6,057,842 | A * | 5/2000 | Knowlton et al. | 715/788 |
| 6,377,262 | B1 * | 4/2002 | Hitchcock et al. | 345/467 |
| 6,411,315 | B1 * | 6/2002 | Young | 715/788 |
| 6,414,698 | B1 * | 7/2002 | Lovell et al. | 715/800 |
| 6,504,544 | B1 * | 1/2003 | Hollingsworth et al. | 345/467 |
| 6,633,303 | B2 * | 10/2003 | Nakajima | 345/629 |
| 6,867,787 | B1 * | 3/2005 | Shimizu et al. | 345/629 |
| 7,257,776 | B2 * | 8/2007 | Bailey et al. | 715/788 |
| 7,320,104 | B2 * | 1/2008 | Lynn et al. | 715/256 |
| 7,596,746 | B2 * | 9/2009 | Kobashi et al. | 715/235 |
| 2006/0066905 | A1 * | 3/2006 | Takashima et al. | 358/1.18 |
| 2006/0265649 | A1 * | 11/2006 | Danilo | 715/542 |

FOREIGN PATENT DOCUMENTS

| | | | |
|---|---|---|---|
| EP | 1308924 | A2 | 5/2003 |
| JP | 4-168488 | A | 6/1992 |
| JP | 4-177295 | A | 6/1992 |
| JP | 5-257450 | A | 10/1993 |
| JP | 5-282311 | A | 10/1993 |
| JP | 8-185397 | A | 7/1996 |
| JP | 2001-265480 | A | 9/2001 |
| JP | 2002-171457 | A | 6/2002 |
| JP | 2002-540460 | A | 11/2002 |
| JP | 2003-140628 | A | 5/2003 |
| WO | WO-00/57305 | A1 | 9/2000 |

* cited by examiner

FIG.4

| Virtual area size | Character size | Number of Characters |
|---|---|---|
| KBT | KLT | KMT |
| KBY | KLY | KMY |

FIG.5

| Type of display screen / Size | A | B | C | ------- |
|---|---|---|---|---|
| Length | 200 | 100 | 20 | ------- |
| Width | 300 | 100 | 140 | ------- |

| Modification of size / Size | Larger | Smaller | Wider | Narrower | Higher | Lower | --- | |
|---|---|---|---|---|---|---|---|---|
| Length | +2 | -1 | ±0 | ±0 | +4 | -3 | | |
| Width | +3 | -2 | +1 | -4 | ±0 | ±0 | | |

| Virtual area size | Character size | Number of Characters |
|---|---|---|
| 20 | 19 | 15 |
| 20 | 19 | 10 |

Pre-modification

| Virtual area size | Character size | Number of Characters |
|---|---|---|
| 20 | 19 | 15 |
| 20 | 15 | 10 |

Post-modification

FIG.12
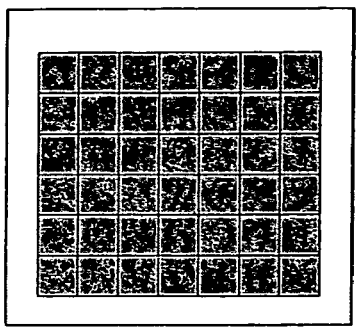
Display screen AA
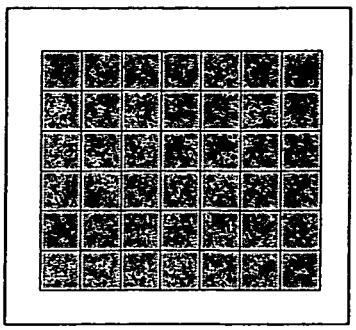
Display screen FF
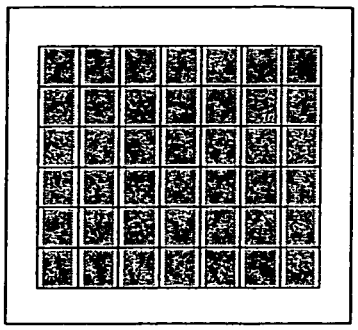
Display screen GG
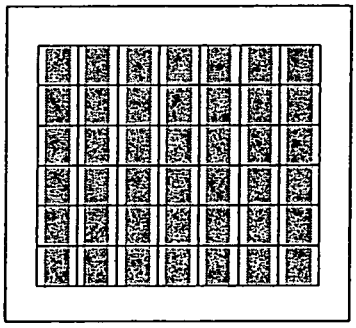
Display screen HH
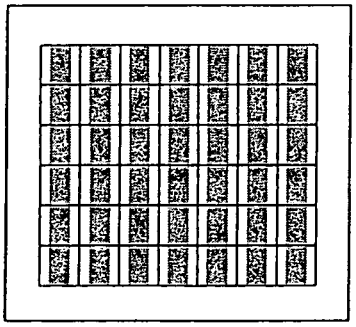
Display screen II FIG.13
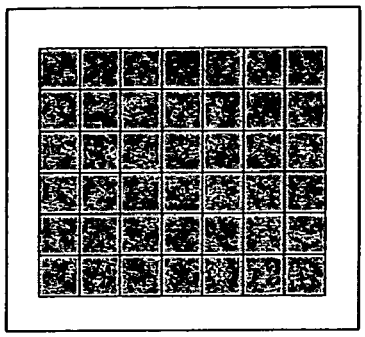
Display screen AA
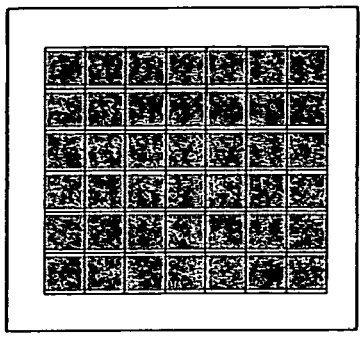
Display screen BB
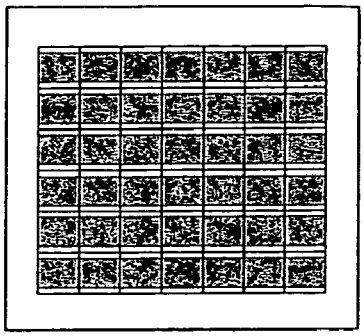
Display screen CC
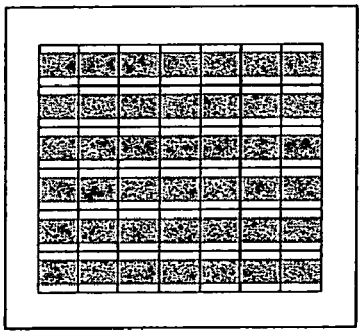
Display screen DD
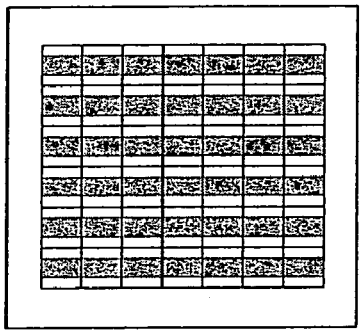
Display screen EE FIG.14
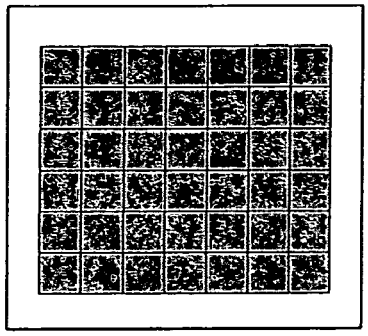
Display screen AA
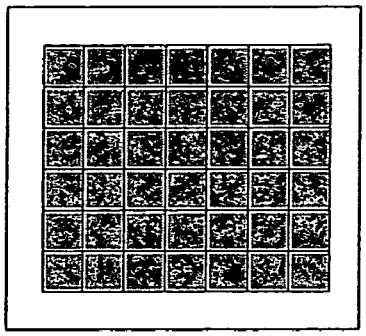
Display screen JJ
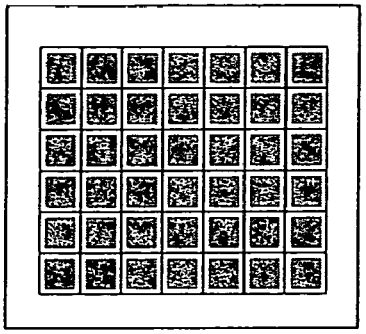
Display screen KK
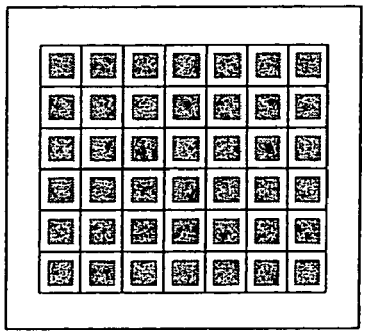
Display screen LL
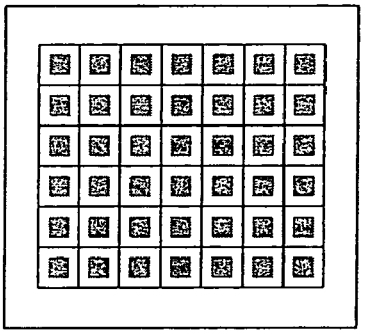
Display screen MM

FIG.16

洋酒といえば、誰でも
最初に思い浮かべるの
がウイスキー。いわば
洋酒のシンボル的な存
在なのだが英語表記が
一般に米ではWhis

FIG.17

ものは存が
でるわな記is
誰べい的表h
ば、が。ル語W
えいキーボ英は
い思スシだ米
とにイのに
酒初ウ酒な般
洋最が洋在一

FIG.18

洋酒といえば、誰でも最初に思い浮かべるのがウイスキー。いわば洋酒のシンボル的な存在なのだが英語表記が一般に米ではＷｈｉｓｋｅｙであることはあまり知られていない。1897年以来両国では、このスペルの差で自国産と輸入品を区別してるという。Whiskdeyのカナ表記にしてもごく稀にウヰスキーという書き方を見かけるが、これとて差別化を意図したものではなく単にカナ使いの時代性にすぎない。

Display area 18A

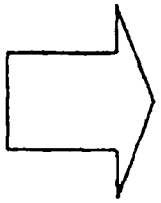

洋酒といえば、誰でも最初に思い浮かべるのがウイスキー。いわば洋酒のシンボル的な存在なのだが英語表記が一般に米ではＷｈｉｓｋｅｙであることはあまり知られていない。1897年以来両国では、このスペルの差で自国産と輸入品を区別してるという。Whiskdeyのカナ表記にしてもごく稀にウヰスキーという書き方を見かけるが、これ

Display area 18B

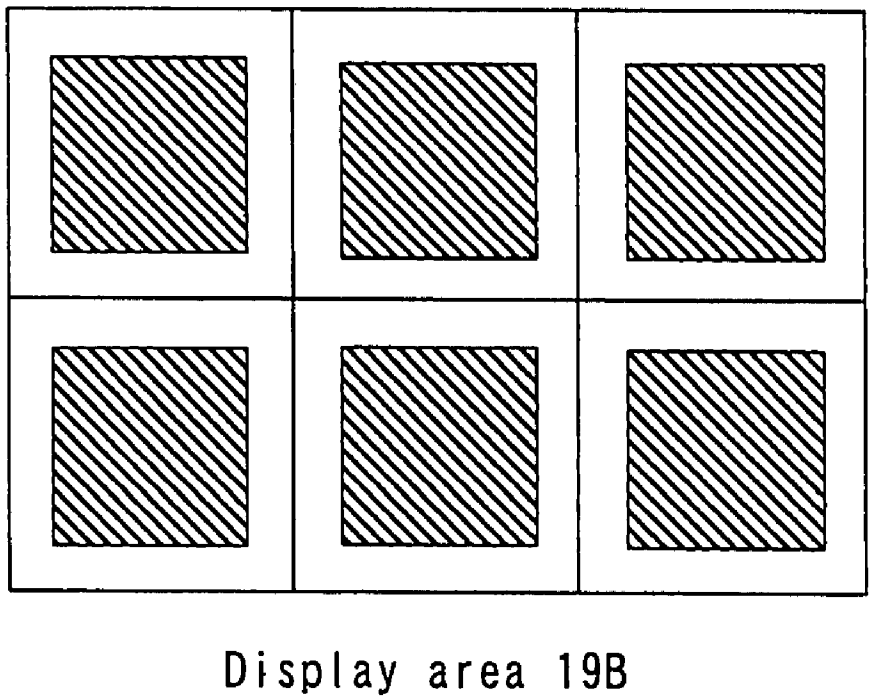
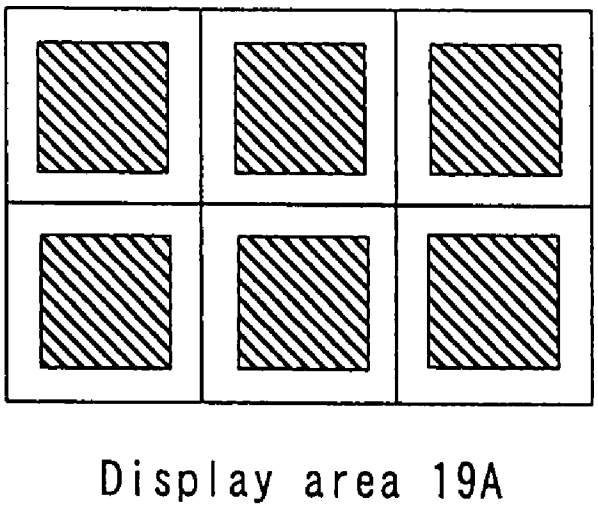
FIG.19

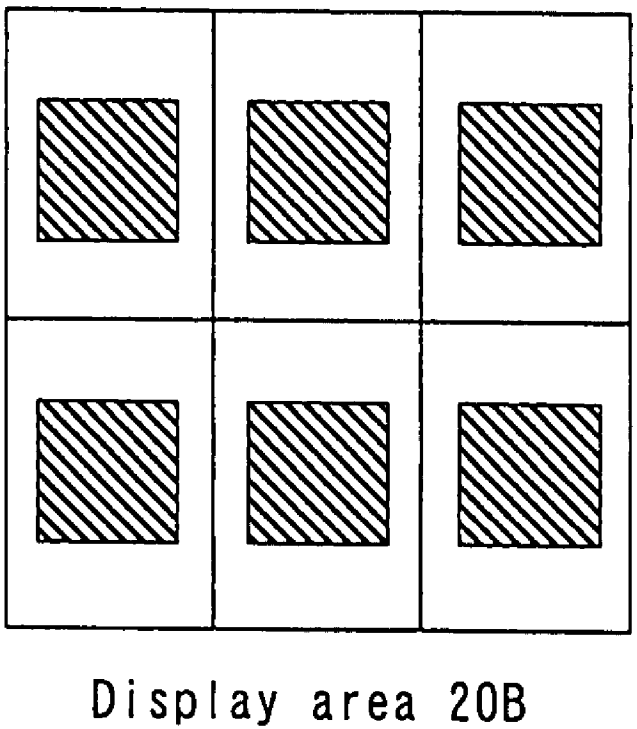
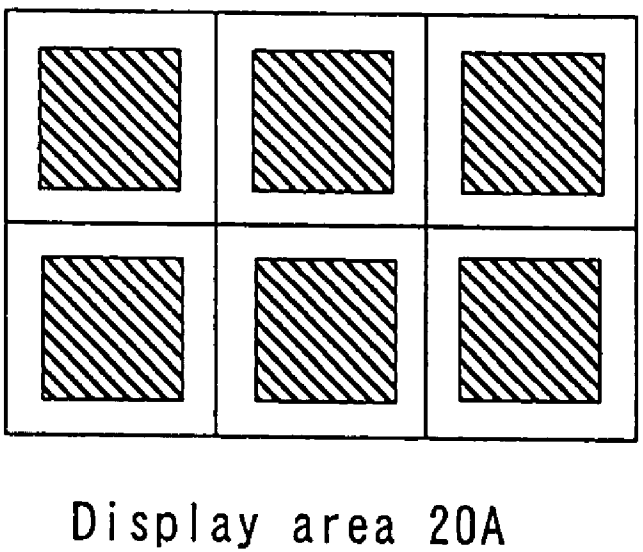
FIG.20

FIG.21
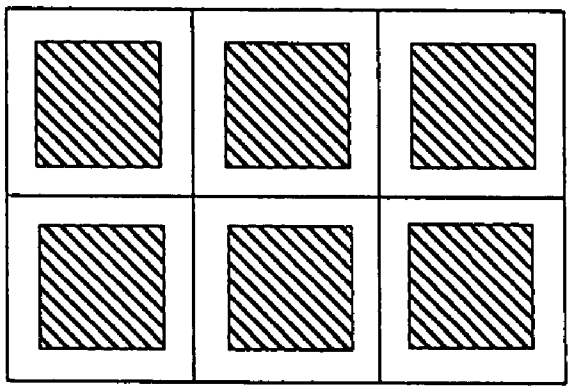
Display area 21A
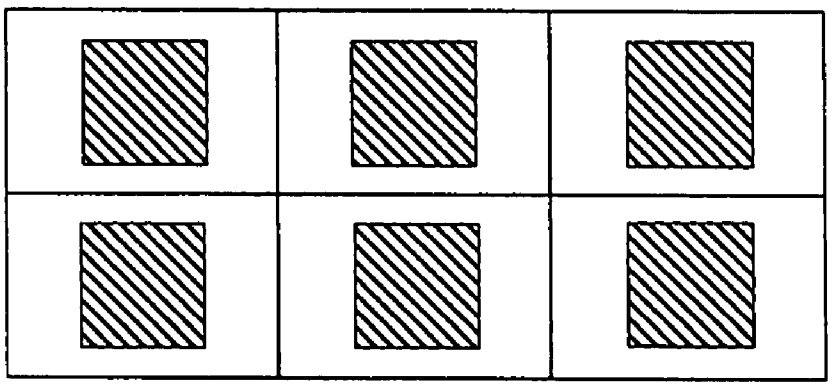
Display area 21B

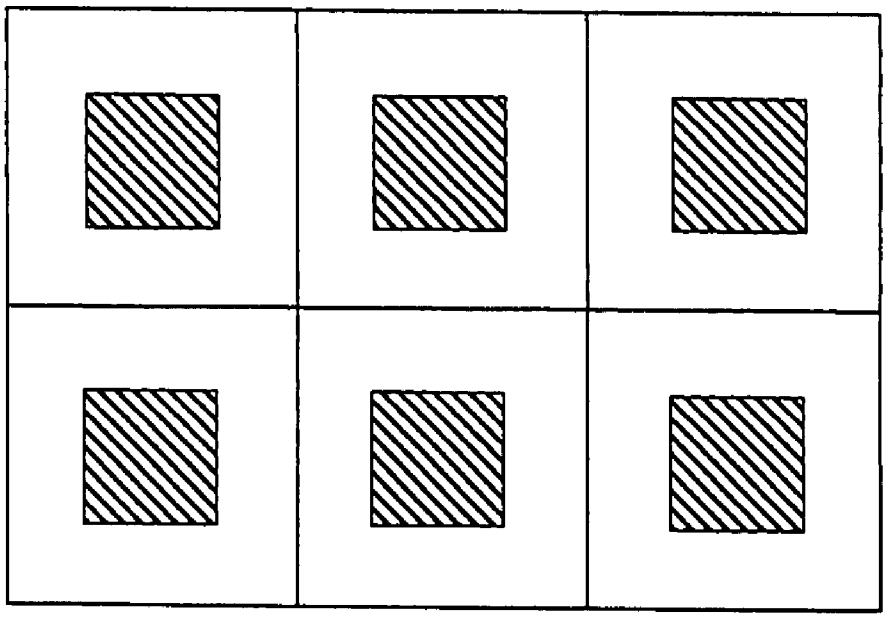
Display area 22B
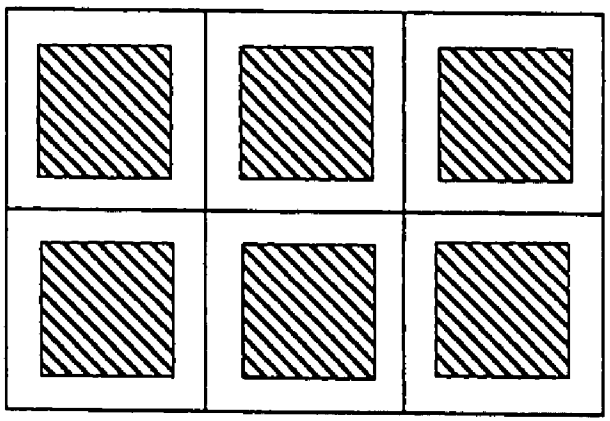
Display area 22A
FIG.22

CHARACTER/GRAPHIC DISPLAY APPARATUS, CHARACTER/GRAPHIC DISPLAY METHOD, PROGRAM, AND RECORDING MEDIUM

TECHNICAL FIELD

The present invention relates to a character/graphic display apparatus including a display device having a display area for displaying a plurality of characters or graphics and also including a control section for controlling the display device, a character/graphic display method, a program, and a recording medium.

BACKGROUND ART

Recently, there have been more and more opportunities for reading characters displayed by a display device included in a mobile information device. A mobile information device includes modification means for modifying character sizes, inter-character spaces, and the like. The user operates the modification means to modify, for example, the character size or the inter-character space provided by the display device to a desired character size or a desired inter-character space.

FIG. 18 shows a display screen which displays characters.

A display screen 18A shows an example in which the characters are displayed densely. It is difficult to read the characters displayed densely.

A display screen 18B shows an example in which the characters are displayed less densely. The user of a mobile information device reads the characters displayed by a display device included therein. The user operates the mobile information device so as to enlarge the inter-character space on the display screen 18A for the purpose of easily reading the characters.

There are two methods (1) and (2) usable by the user to enlarge the inter-character space for easily reading the characters. With method (1), the character size is enlarged and the inter-character space is enlarged. With method (2), the character size is not changed and the inter-character space is enlarged.

FIG. 19 shows an example of a display area which displays characters, the space between which is enlarged by method (1). A display area 19A is a display area before the inter-character space is enlarged. A display area 19B is a display area after the inter-character space is enlarged. It is assumed herein that in each of the hatched zones in the display areas, a character having the same size as that of the corresponding hatched zone is displayed.

FIG. 20 shows an example of a display area which displays characters, the space between which is enlarged by method (2). A display area 20A is a display area before the inter-character space in a length direction is enlarged. A display area 20B is a display area after the inter-character space in the length direction is enlarged. It is assumed herein that in each of the hatched zones in the display areas, a character having the same size as that of the corresponding hatched zone is displayed.

FIG. 21 shows an example of a display area which displays characters, the space between which is enlarged by method (2). A display area 21A is a display area before the inter-character space in the width direction is enlarged. A display area 21B is a display area after the inter-character space in a width direction is enlarged. It is assumed herein that in each of the hatched zones in the display areas, a character having the same size as that of the corresponding hatched zone is displayed.

FIG. 22 shows an example of a display area which displays characters, the space between which is enlarged by method (2). A display area 22A is a display area before the inter-character space in the width direction and the length direction is enlarged. A display area 22B is a display area after the inter-character space in the width direction and the length direction is enlarged. It is assumed herein that in each of the hatched zones in the display areas, a character having the same size as that of the corresponding hatched zone is displayed.

Japanese Laid-Open Publication No. 2002-171457 discloses a method for prohibiting the characters from being displayed and a method for displaying the characters in an enlarged state, both when the characters displayed by the display device are difficult to read as a result of being reduced (see Patent Document 1).

Japanese Laid-Open Publication No. 2001-265480 discloses a method for modifying the character size in compliance with the size of the display area (see Patent Document 2).

Japanese Laid-Open Publication No. 4-177295 discloses a method for first enlarging a plurality of characters and then reducing the inter-character space (see Patent Document 3).

Japanese Laid-Open Publication No. 5-257450 discloses a method for modifying the enlargement ratio of a character and a virtual area (see Patent Document 4).

Patent Document 1: Japanese Laid-Open Publication No. 2002-171457

Patent Document 2: Japanese Laid-Open Publication No. 2001-265480

Patent Document 3: Japanese Laid-Open Publication No. 4-177295

Patent Document 4: Japanese Laid-Open Publication No. 5-257450

DISCLOSURE OF THE INVENTION

Problems to be Solved by the Invention

However, conventional character display apparatuses have the drawback that the positions at which the characters are displayed are changed and so the layout is not maintained. The reason is that when a conventional character display apparatus is used to enlarge the inter-character space, it is necessary to modify the positions at which the characters are displayed. In the case where the layout is not maintained, it is difficult to grasp the positions at which the characters are displayed and to understand the intention of the sender of the message.

FIG. 23 shows exemplary display areas which display the characters, the space between which is enlarged by method (1).

A display area 23A and a display area 23B are display areas before the inter-character space is enlarged. A display area 23A' and a display area 23B' are display areas after the inter-character space is enlarged. As displayed in the display area 23A', the positions of the characters have been changed as a result of the size of the characters in the display area 23A being enlarged and the inter-character space being enlarged. As displayed in the display area 23B', the positions of the characters have been changed as a result of the size of the characters in the display area 23B being enlarged and the inter-character space being enlarged.

FIG. 24 shows exemplary display areas which display the characters, the space between which is enlarged by method (2).

A display area 24A and a display area 24B are display areas before the inter-character space is enlarged. A display area 24A' and a display area 24B' are display areas after the inter-character space is enlarged. As displayed in the display area 24A', the positions of the characters have been changed as a result of the inter-character space in the length direction being enlarged. As displayed in the display area 24B', the positions of the characters have been changed as a result of the inter-character space in the length direction being enlarged.

FIG. 25 shows exemplary display areas which display the characters, the space between which is enlarged by method (2).

A display area 25A and a display area 25B are display areas before the inter-character space is enlarged. A display area 25A' and a display area 25B' are display areas after the inter-character space is enlarged. As displayed in the display area 25A', the positions of the characters have been changed as a result of the inter-character space in the width direction being enlarged. As displayed in the display area 25B', the positions of the characters have been changed as a result of the inter-character space in the width direction being enlarged.

FIG. 26 shows exemplary display areas which display the characters, the space between which is enlarged by method (2).

A display area 26A and a display area 26B are display areas before the inter-character space is enlarged. A display area 26A' and a display area 26B' are display areas after the inter-character space is enlarged. As displayed in the display area 26A', the positions of the characters have been changed as a result of the inter-character space in the width direction and the length direction being enlarged. As displayed in the display area 26B', the positions of the characters have been changed as a result of the inter-character space in the width direction and the length direction being enlarged.

The present invention, made in light of the above-described situation, has an objective of providing a character/graphic display apparatus, a character/graphic display method, a program, and a recording medium for improving the visual recognizability (ease of reading, or ease of recognition through reading) of characters or graphics, without changing the layout of the characters or graphics.

Means for Solving the Problems

A character/graphic display apparatus according to the present invention includes a display device including a display area for displaying a plurality of characters or graphics; and a control section for controlling the display device. The display area includes a plurality of virtual areas. The control section modifies the size of each of the plurality of characters or graphics while maintaining the size of each of the plurality of virtual areas included in the display area. The control section controls the display device, such that each of the plurality of characters or graphics having the modified size is displayed in the respective virtual area among the plurality of virtual areas. The above-described objective can be achieved by this.

The size of each of the plurality of characters or graphics may be defined by a length and a width thereof. The control section may modify the size of each of the plurality of characters or graphics such that at least one of the length and the width is modified.

The control section may modify the size of each of the plurality of characters or graphics such that the ratio of the length and the width is maintained.

The control section may modify the size of each of the plurality of characters or graphics such that the ratio of the length and the width is changed.

The display area may include a plurality of pixels. Each of the plurality of pixels may be divided into a plurality of sub-pixels. The control section may modify the size of each of the plurality of characters or graphics sub-pixel by sub-pixel.

The character/graphic display apparatus may further include a storage section for storing a character/graphic modification information table. The character/graphic modification information table may include a plurality of pieces of character/graphic modification information. Each of the plurality of pieces of character/graphic modification information may be information for modifying the size of each of the plurality of characters or graphics. The control section may select at least one piece of character/graphic modification information from the character/graphic modification information table including the plurality of pieces of character/graphic modification information. The control section may modify the size of each of the plurality of characters or graphics in accordance with the selected at least one piece of character/graphic modification information.

A character/graphic display method according to the present invention is for displaying a plurality of characters or graphics by a display device including a display area. The display area includes a plurality of virtual areas. The character/graphic display method includes the steps of modifying the size of each of the plurality of characters or graphics while maintaining the size of each of the plurality of virtual areas included in the display area; and controlling the display device so as to display each of the plurality of characters or graphic shaving the modified size in the respective virtual area among the plurality of virtual areas. The above-described objective can be achieved by this.

A program according to the present invention is for allowing a character/graphic display apparatus, which includes a display device having a display area for displaying a plurality of characters or graphics and also includes a control section for controlling the display device, to execute character/graphic display processing. The display area includes a plurality of virtual areas. The character/graphic display processing includes the steps of modifying the size of each of the plurality of characters or graphics while maintaining the size of each of the plurality of virtual areas included in the display area; and controlling the display device so as to display each of the plurality of characters or graphics having the modified size in the respective virtual area among the plurality of virtual areas. The above-described objective can be achieved by this.

A recording medium according to the present invention is readable by a character/graphic display apparatus which includes a display device having a display area for displaying a plurality of characters or graphics and also includes a control section for controlling the display device. The display area includes a plurality of virtual areas. The recording medium has a program recorded thereon for allowing the control section to execute processing which includes the steps of modifying the size of each of the plurality of characters or graphics while maintaining the size of each of the plurality of virtual areas included in the display area; and controlling the display device so as to display each of the plurality of characters or graphics having the modified size in the respective virtual area among the plurality of virtual areas. The above-described objective can be achieved by this.

EFFECT OF THE INVENTION

According to the present invention, the control section modifies the size of each of the plurality of characters or graphics while maintaining the size of each of the plurality of virtual areas included in the display area, and displays each of the plurality of characters or graphics having the modified size in the respective virtual area among the plurality of virtual areas.

In this manner, the character/graphic display apparatus according to the present invention modifies the size of each of a plurality of characters or graphics while maintaining the size of each of a plurality of virtual areas. Thus, the size of each of the plurality of characters or graphics is enlarged, or inter-character spaces, spaces between characters and graphics, and inter-graphic spaces are enlarged. As a result, the visual recognizability (ease of reading, or ease of recognition through reading) of characters or graphics is improved.

The character/graphic display apparatus according to the present invention maintains the size of each of the plurality of virtual areas included in the display area. Thus, the position of each of the plurality of virtual areas included in the display area is maintained. Each of the plurality of characters or graphics is displayed in the respective virtual area among the plurality of virtual areas. Therefore, the position at which each of the plurality of characters or graphics is displayed is kept within the respective virtual area among the plurality of virtual areas. Accordingly, the layout of the plurality of characters or graphics is prevented from being changed.

As a result, the visual recognizability (ease of readability, or ease of recognition through reading) of characters or graphics can be improved without changing the layout of the characters or graphics.

BRIEF DESCRIPTION OF THE DRAWINGS

FIG. 4 shows a character basic information table 143.

FIG. 5 shows a display screen information table 144.

FIG. 12 shows exemplary display screens including the virtual areas shown in FIG. 11.

FIG. 13 shows exemplary display screens including the virtual areas shown in FIG. 11.

FIG. 14 shows exemplary display screens including the virtual areas shown in FIG. 11.

FIG. 16 shows a plurality of characters displayed by the display device.

FIG. 17 shows a plurality of characters displayed by the display device after the character display program 141 is executed.

FIG. 18 shows display screens which display characters.

FIG. 19 shows an exemplary display area which displays characters, the space between which is enlarged by method (1).

FIG. 20 shows an exemplary display area which displays characters, the space between which is enlarged by method (2).

FIG. 21 shows an exemplary display area which displays characters, the space between which is enlarged by method (2).

FIG. 22 shows an exemplary display area which displays characters, the space between which is enlarged by method (2).

DESCRIPTION OF THE REFERENCE NUMERALS

Figure 1:
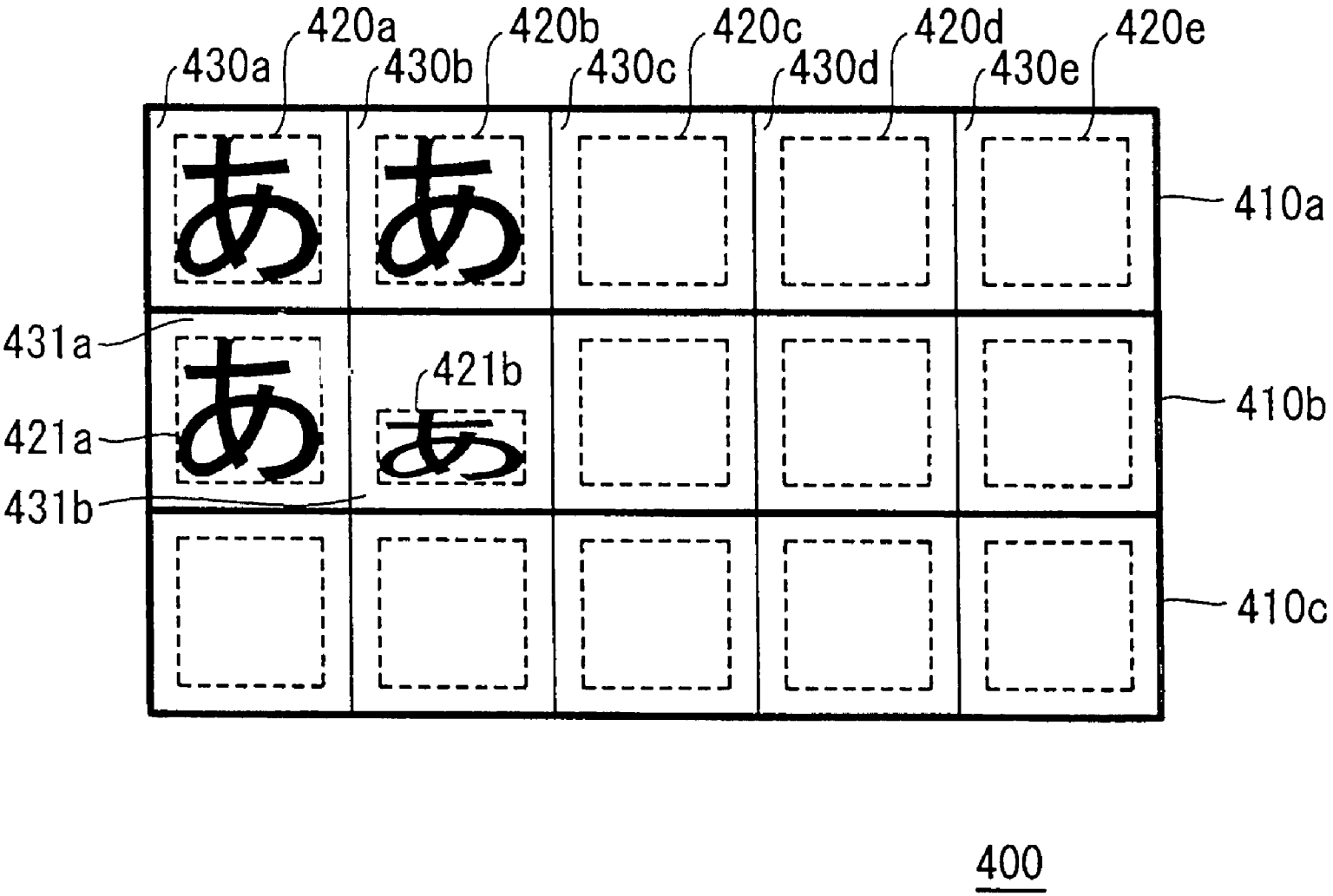
FIG. 1 shows a display screen 400 of a display device included in a character display apparatus according to the present invention.

100 Character display apparatus
110 Display device
120 Control section
121 CPU
122 Main memory
130 Input device
140 Assisting memory device
141 Character display program
142 Character data
143 Character basic information table
144 Display screen information table
145 Character modification information table

BEST MODE FOR CARRYING OUT THE INVENTION

FIG. 1 shows a display screen 400 of a display device included in a character display apparatus according to the present invention.

The display screen 400 includes display areas 410*a*, 410*b* and 410*c*. In each of the display areas 410*a*, 410*b* and 410*c*, a plurality of characters are to be displayed. The size of each of the display areas 410*a*, 410*b* and 410*c* is defined by the logical product of the length and the width of the respective display area. Characters include, for example, "hiragana" Japanese phonetic letters, "katakana" Japanese phonetic letters, Chinese characters, alphabets, pictographs, and numerals.

The display area 410*a* includes character areas 420*a*, 420*b*, 420*c*, 420*d* and 420*e*. In each of the character areas 420*a*, 420*b*, 420*c*, 420*d* and 420*e*, one character is to be displayed. The display area 410*b* includes character areas 421*a* and 421*b*. In each of the character areas 421*a* and 421*b*, one character is to be displayed.

The size of each of the character areas 420*a*, 420*b*, 420*c*, 420*d* and 420*e* is defined by the logical product of the length and the width of the respective character area.

In this specification, the expression "the size of a character" means the size of a character area in which the character is displayed. For example, where a character area in which one character is displayed has a length x and a width y, the size of the character is xy. According to this definition, a space representing a blank space and having a prescribed size, hiragana "よ" and hiragana "よ" (contracted sound) have the same size as long as they are displayed in character areas of an identical size.

The display areas 410*a*, 410*b* and 410*c* each include a plurality of character areas arranged in a width direction. However, the plurality of character areas are not limited to be arranged in the width direction. The display areas 410*a*, 410*b* and 410*c* may include a plurality of character areas arranged in a length direction.

The display area 410*a* includes virtual areas 430*a*, 430*b*, 430*c*, 430*d* and 430*e*. The virtual areas 430*a*, 430*b*, 430*c*, 430*d* and 430*e* are spread in the display area 410*a* without overlapping each other. Each virtual area includes a character area. The character are as 420*a*, 420*b*, 420*c*, 420*d* and 420*e* are included in, and correspond to, the virtual areas 430*a*, 430*b*, 430*c*, 430*d* and 430*e*, respectively.

The display area 410*b* includes virtual areas 431*a* and 431*b*. The character areas 421*a* and 421*b* are included in, and correspond to, the virtual areas 431*a* and 431*b*, respectively.

The size of each of the virtual areas 430*a*, 430*b*, 430*c*, 430*d* and 430*e* is defined by the logical product of the length and the width of the respective virtual area.

Figure 2:
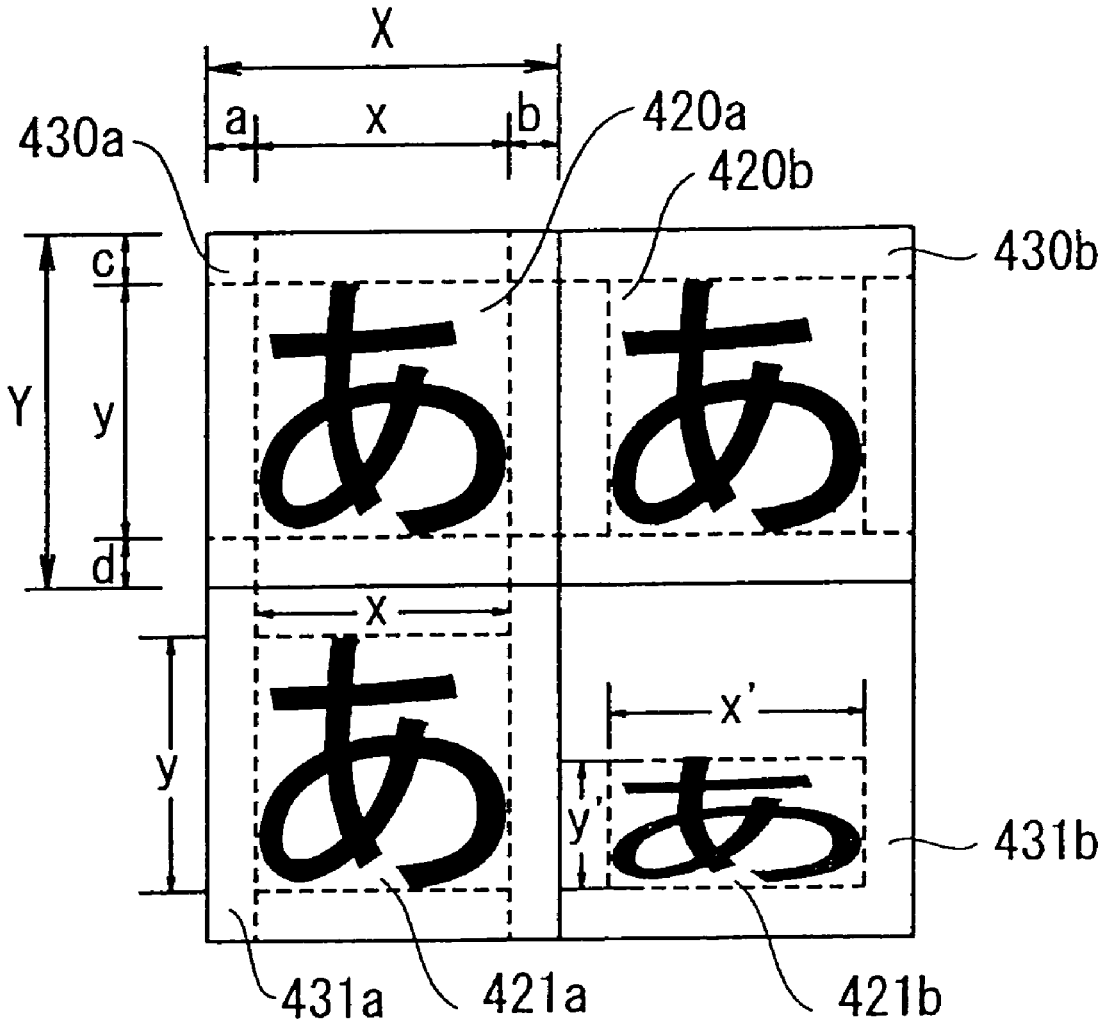
FIG. 2 shows the positional relationship between the virtual areas and the character areas.

FIG. 2 shows the positional relationship between a virtual area and a character area.

The character area 420*a* and the character area 420*b* are adjacent to each other and arranged in the width direction. The character area 421*a* and the character area 420*a* are adjacent to each other and arranged in the length direction.

In this specification, the distance between two adjacent character areas is referred to as a "inter-character space". In the case where two adjacent character areas are arranged in the length direction, the inter-character space of those character areas will be specifically referred to as an "inter-row space". In the case where two adjacent character areas are arranged in the width direction, the inter-character space of those character areas will be specifically referred to as an "inter-column space".

The character areas 420*a*, 420*b* and 421*a* each have a width of x and a length of y. The distance between the character areas 420*a* and 420*b* is an inter-column space (a+b). The distance between the character areas 420*a* and 421*a* is an inter-row space (c+d). The virtual areas 430*a*, 430*b* and 431*a* each have a width X and a length Y. In this case, the virtual areas 430*a*, 430*b* and 431*a* are each surrounded by a frame having the width X (X=x+a+b) and the length Y (Y=y+c+d). In this case, each of frames having the width x and the length y matches an outer perimeter of each of the character areas 420*a*, 420*b* and 421*a*. Accordingly, when the inter-row space and the inter-column space are both 0, the virtual area 430*a* and the character area 420*a* are the same area, the virtual area 430*b* and the character area 420*b* are the same area, and the virtual area 431*a* and the character area 421*a* are the same area.

The size of the character (width: x'; length: y') displayed in the character area 421*b* is smaller than the size of the character (width: x; length: y) displayed in the character area 421*a*. This means that there is the relationship $x' \cdot y' < x \cdot y$. For example, any of the following relationships is applicable: $x'<x$ and $y'<y$; $x'<x$ and $y'=y$; and $x'=x$ and $y'<y$.

Figure 3:
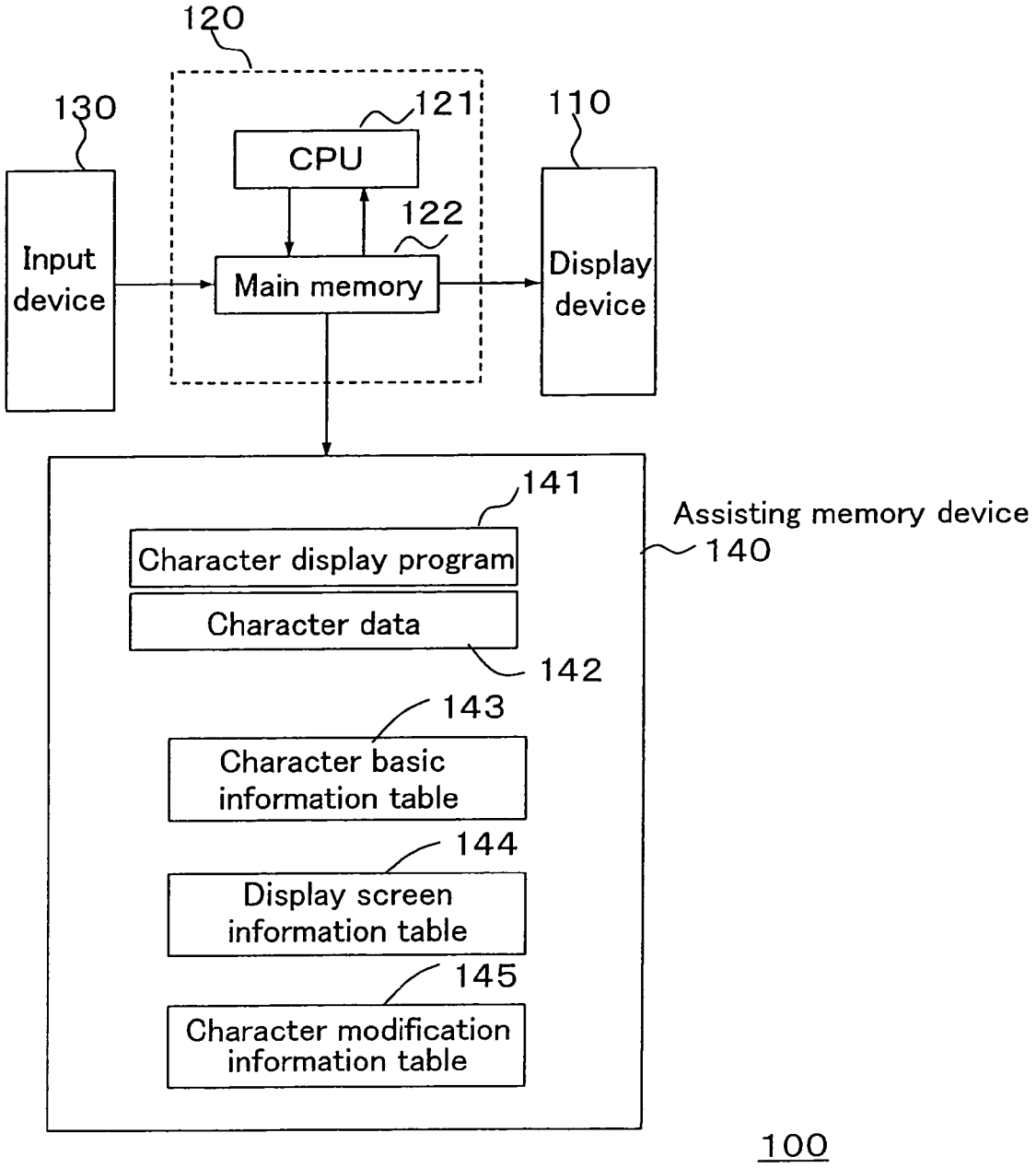
FIG. 3 shows a structure of a character display apparatus 100 according to an example of the present invention.

FIG. 3 shows a structure of a character display apparatus 100 in one example according to the present invention.

The character display apparatus 100 may be, for example, a personal computer. As the personal computer, any type of computer such as, for example, a desk-top type or lap-top type computer is usable. Alternatively, the character display apparatus 100 may be a wordprocessor.

The character display apparatus 100 may be any information display apparatus such as, for example, an electronic device or an information device including a display device. For example, the character display apparatus 100 may be an electronic device, a mobile information terminal used as a mobile information tool, a cellular phone or a PHS terminal, a communication device such as a general telephone/facsimile machine, a game machine, a TV, a PDA or the like, which includes a liquid display device.

The character display apparatus 100 includes a display device 110 for displaying a plurality of characters, a control section 120 for controlling the display device 110, an input device 130, and an assisting memory device 140. The control section 120 is connected with the display device 110, the input device 130 and the assisting memory device 140.

The display device 110 includes a display area having a plurality of pixels. The display device 110 also includes a display screen 400 (not shown in FIG. 3; see FIGS. 1 and 2). As the display device 110, any display device having a function of displaying characters is usable. The display device 110 is, for example, a liquid crystal display device.

The input device 130 is used for supplying the control section 120 with character information representing a character to be displayed by the display device 110 and an instruction to the display device 110. The character information includes, for example, a character code for identifying a character. As the input device 130, any type of input device capable of inputting character information is usable. For example, a keyboard including cursor keys, ten keys and function keys is preferably usable as the input device 130.

The assisting memory device 140 stores a character display program 141, character data 142, a character basic information table 143, a display screen information table 144, and a character modification information table 145. As the assisting memory device 140, any type of memory device capable of storing the character display program 141, the character data 142, the character basic information table 143, the display screen information table 144, and the character modification information table 145 is usable. In the assisting memory device 140, any recording medium is usable as a recording medium for storing the character display program 141, the character data 142, the character basic information table 143, the display screen information table 144, and the character modification information table 145. Recording mediums such as, for example, hard discs, CD-ROMs, MOs, MDs, DVDs, IC cards, and optical cards are preferably usable.

The character display program 141, the character data 142, the character basic information table 143, the display screen information table 144, and the character modification information table 145 are not limited to being stored on a recording medium in the assisting memory device 140. For example, the character display program 141, the character data 142, the character basic information table 143, the display screen information table 144, and the character modification information table 145 may be stored in a main memory 122 or a ROM (not shown). The ROM may be, for example, a mask ROM, an EPROM, an EEPROM, or a flash ROM. In the case of a ROM system of storing information in a ROM, various types of processing can be realized simply by exchanging ROMs. The ROM system is preferably applicable when, for example, the character display apparatus 100 is a mobile terminal or a cellular phone.

The recording medium for storing the character display program 141, the character data 142, the character basic information table 143, the display screen information table 144, and the character modification information table 145 may be a medium such as a disc, card, other memory devices or a semiconductor memory, for fixedly carrying a program or data. Alternatively, the recording medium may be a medium for fluidly carrying a program or data, for example, a communication medium used for carrying a program or data in a communication network. In the case where the character display apparatus 100 includes means for connection with a communication line including the Internet, the character display program 141, the character data 142, the character basic information table 143, the display screen information table 144, and the character modification information table 145 can be downloaded from the communication line. In this case, a loader program necessary for downloading may be pre-stored in the ROM (not shown) or installed into the control section 120 from the assisting memory device 140.

The control section 120 includes a CPU 121 and a main memory 122.

The CPU 121 controls and monitors the entirety of the character display apparatus 100 and also executes the character display program 141 stored in the assisting memory device 140.

The main memory 122 temporarily stores data input from the input device 130, data to be displayed by the display device 110, and data necessary for executing the character display program 141. The main memory 122 is accessed by the CPU 121.

The CPU 121 executes the character display program 141 based on various types of data stored in the main memory 122, so as to modify the size of each of the plurality of characters while maintaining the size of each of the plurality of virtual areas included in the display area. Each of the plurality of modified characters is once stored in the main memory 122 and then output to the display device 110. Each of the plurality of characters modified to correspond to the respective virtual area among the plurality of virtual areas is displayed in the respective virtual area.

The function of the character display program 141 will be described later in detail.

The character data 142 defines the shape of a character. The character data 142 is, for example, vector data defining the shape of a vector font. The character data 142 may be outline data defining the shape of an outline font.

FIG. 4 shows the character basic information table 143.

The character basic information table 143 includes data indicating lengths of the virtual areas (KBT), data indicating widths of the virtual areas (KBY), data indicating lengths of the characters (KLT), and data indicating widths of the characters (KLY). However, data included in the character basic information table 143 is not limited to such data. The character basic information table 143 may include data indicating the number of characters which can be displayed on the display screen 400 in the length direction (KMT) and data indicating the number of characters which can be displayed on the display screen 400 in the width direction (KMY).

FIG. 5 shows a display screen information table 144.

The display screen information table 144 includes data indicating the lengths of a plurality of types of display screens, and data indicating the widths of the plurality of types of display screens.

Figures 6, 7:
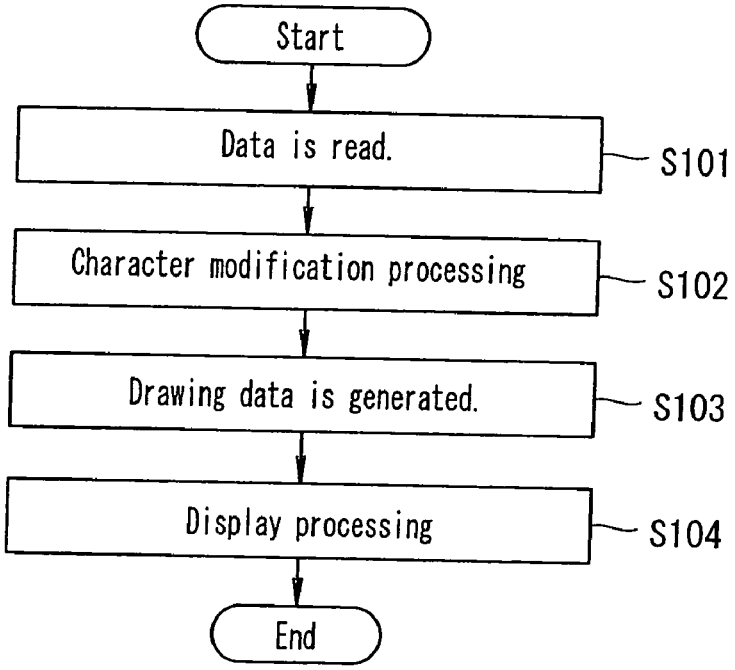
FIG. 6 shows a character modification information table 145.
FIG. 7 is a flowchart illustrating a processing procedure of a character display program 141.

FIG. 6 shows a character modification information table 145. The character modification information table 145 includes a plurality of pieces of character modification information. The character modification information is information for modifying the size of characters.

For example, the character modification information indicates how much the size of a character is to be modified. The character modification information labeled "larger" indicates that the length of the character is to be extended by 2 and the width of the character is to be extended by 3. The character modification information labeled "smaller" indicates that the length of the character is to be shortened by 1 and the width of the character is to be shortened by 2. The character modification information labeled "wider" indicates that the length of the character is not to be modified and the width of the character is to be extended by 1. The character modification information labeled "narrower" indicates that the length of the character is not to be modified and the width of the character is to be shortened by 4. The character modification information labeled "higher" indicates that the length of the character is to be extended by 4 and the width of the character is not to be modified. The character modification information labeled "lower" indicates that the length of the character is to be shortened by 3 and the width of the character is not to be modified.

The character modification information is not limited to indicating how much the size of a character is to be modified. The character modification information may indicate post-modification length and width of the character. The character modification information may indicate that at least one of the length and width of the character is to be modified. The character modification information may indicate that the size of the character is to be modified such that the ratio of the length and the width of the character is maintained even after the modification. The character modification information may indicate that the size of the character is to be modified such that the ratio of the length and the width of the character is changed after the modification.

The CPU 121 uses the character data 142, the data included in the character basic information table 143, the data included in the display screen information table 144, and the data included in the character modification information table 145, to execute the character display program 141.

FIG. 7 is a flowchart illustrating a processing procedure of the character display program 141. The character display program 141 is executed by the CPU 121.

Hereinafter, the processing procedure of the character display program 141 will be described step by step with reference to FIG. 7.

Step S101: Character information indicating a character to be displayed by the display device 130 is input to the main memory 122 via the input device 130. Based on the input character information, the CPU 121 reads the character data 142 stored in the assisting memory device 140 from the assisting memory device 140 and inputs the character data 142 to the main memory 122. The CPU 121 reads the data included in the character basic information table 143 and the data included in the display screen information table 144 from the assisting memory device 140, and inputs the read data to the main memory 122. The CPU 121 selects at least one piece of character modification information from the plurality of pieces of character modification information included in the character modification information table 145, and inputs the selected at least one piece of character modification information to the main memory 122. The character modification information is not limited to being pre-stored in the character modification information table 145. The user may input desired character modification information to the main memory 122 via the input device 130.

After the CPU 121 inputs the data included in the character basic information table 143, the data included in the display screen information table 144, and the character modification information selected by the CPU 121, to the main memory 122, the CPU 121 proceeds with the processing step S102.

Step S102: The CPU 121 determines the size of the display screen based on the data included in the display screen information table 144. Based on the selected character modification information, the CPU 121 modifies the data indicating the length of the character area and the data indicating the width of the character area which are included in the character basic information table 143. The modification of such data is executed by the CPU 121 while the size of the virtual area is maintained.

Figures 8, 9:
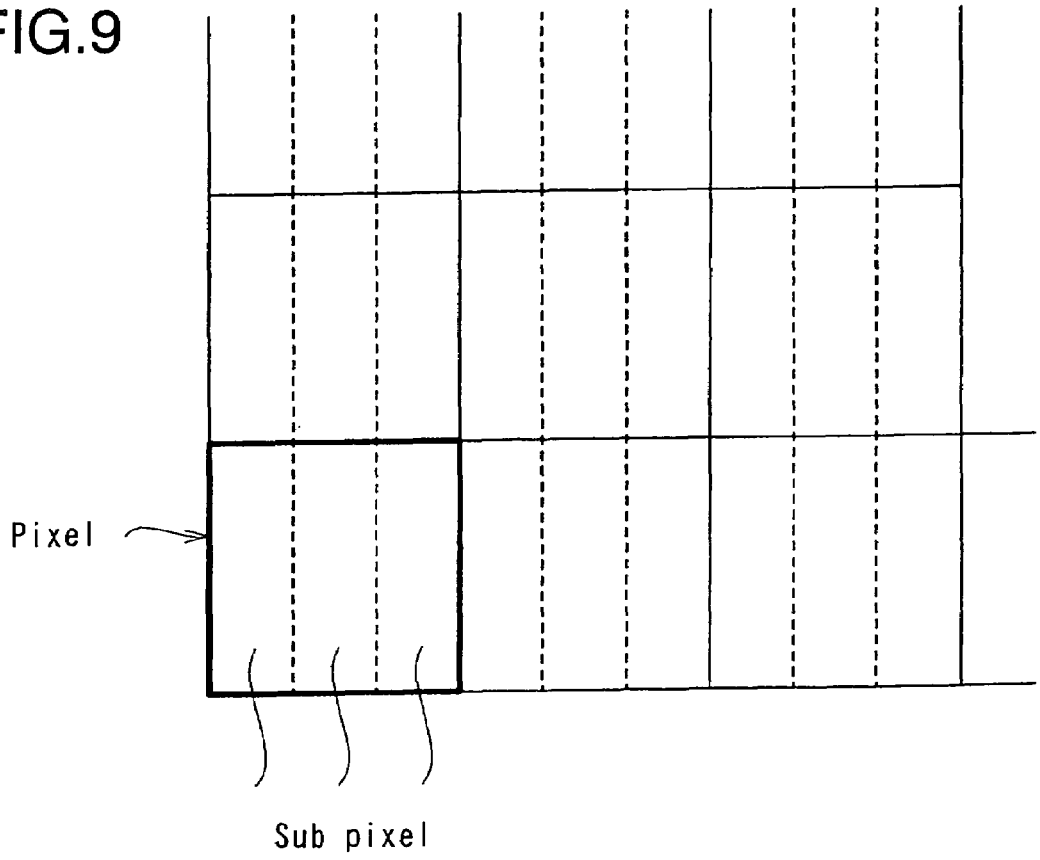
FIG. 8 shows an exemplary character basic information table before the modification by the CPU 121, and an exemplary character basic information table after the modification by the CPU 121.
FIG. 9 shows the relationship of the shape of a pixel and the shape of a sub-pixel.

FIG. 8 shows an example of the character basic information table before the modification by the CPU 121 and an example of the character basic information table after the modification by the CPU 121.

In the case where the character modification information selected by the CPU 121 is, for example, "narrower" the character basic information table is modified such that the width of the character is shortened by 4 without the length of the character being modified. Among the data included in the character basic information table, the data indicating the length of the character remains 19 whereas the data indicating the width of the character is modified from 19 to 15.

Among the data included in the character basic information table, the data indicating the length of the virtual area before the character size is modified is 20, and the data indicating the width of the virtual area before the character size is modified is 20. The data indicating the length of the virtual area after the character size is modified is 20, and the data indicating the width of the virtual area after the character size is modified is 20. The CPU 121 maintains the data indicating the length of the virtual area even after the modification of the character size. The CPU 121 maintains the data indicating the width of the virtual area even after the modification of the character size.

Among the data included in the character basic information table, the data indicating the number of characters which can be displayed on the display screen 400 in the length direction before the modification of the character size is 15, and the data indicating the number of characters which can be displayed on the display screen 400 in the width direction before the modification of the character size is 10. The data indicating the number of characters which can be displayed on the display screen 400 in the length direction after the modification of the character size is 15, and the data indicating the number of characters which can be displayed on the display screen 400 in the width direction after the modification of the character size is 10.

The CPU 121 does not necessarily modify both of the data indicating the length of the character area and the data indicating the width of the character area. The CPU 121 may modify either the data indicating the length of the character area or the data indicating the width of the character area. In this case, the CPU 121 generates data having a character having the modified size based on the modified data and non-modified data.

After modifying the character basic information table, the CPU 121 proceeds with the processing to step S103.

Step S103: The CPU 121 generates drawing data from the data indicating the character having the modified size, such that the data indicating the character having the modified size can be displayed by the display device. For example, the CPU 121 generates drawing data from the data indicating the character having the modified size using a straight line drawing program or a curve drawing program such as a spline or the like. The generated drawing data is stored in the main memory 122.

For example, the CPU 121 generates drawing data based on the post-modification character basic information table shown in FIG. 8. The drawing data is generated from the data indicating the character having the modified size (the data indicating the length of the character is 19 and the data indicating the width of the character is 15).

After storing the generated drawing data in the main memory 122, the CPU 121 proceeds with the processing to step S104.

Step S104: Based on the drawing data generated in step S103, the CPU 121 controls the display device 110 such that the character having the modified size is displayed in the virtual area included in the display screen 400 of the display device 110.

For example, the CPU 121 modifies the data included in the character basic information table shown in FIG. 8 before the characters are displayed. In accordance with the modified data, the CPU 121 determines the size of the characters, the size of the virtual areas, and the number of characters. For example, in the case where the width of the characters is to be narrowed while the size of the virtual areas is maintained, the data included in the character basic information table shown in FIG. 8 is modified such that the width of the characters is shortened, without modifying the data indicating the size of the virtual areas. In the example shown in FIG. 8, the data indicating the width of the characters is modified from 19 to 15.

In the case where the display device is a liquid crystal display device, a plurality of pixels are provided in the display screen of the display device. Each of the plurality of pixels is divided into a plurality of sub-pixels. To each of the plurality of sub-pixels, a respective color element is assigned among a plurality of color elements (for example, R(red), G (green) and B (blue)). The CPU 121 can control the character size pixel by pixel, but is not limited to this. In the case where the display device is a liquid crystal display device, the CPU 121 may control the character size sub-pixel by sub-pixel. The CPU 121 can control the display device so as to modify the character size sub-pixel by sub-pixel. In this case, the character size can be controlled more precisely than the case where the CPU 121 modifies the character size pixel by pixel.

FIG. 9 shows the relationship between the shape of a pixel and the shape of a sub-pixel.

The sub-pixel is made by dividing the pixel into three and has a shape of a strip longer in the length direction. However, the sub-pixel is not limited to being strip-shaped longer in the length direction. The sub-pixel may have a shape of a strip longer in the width direction. The sub-pixel may have any shape which can be made by dividing the pixel.

Figure 10:
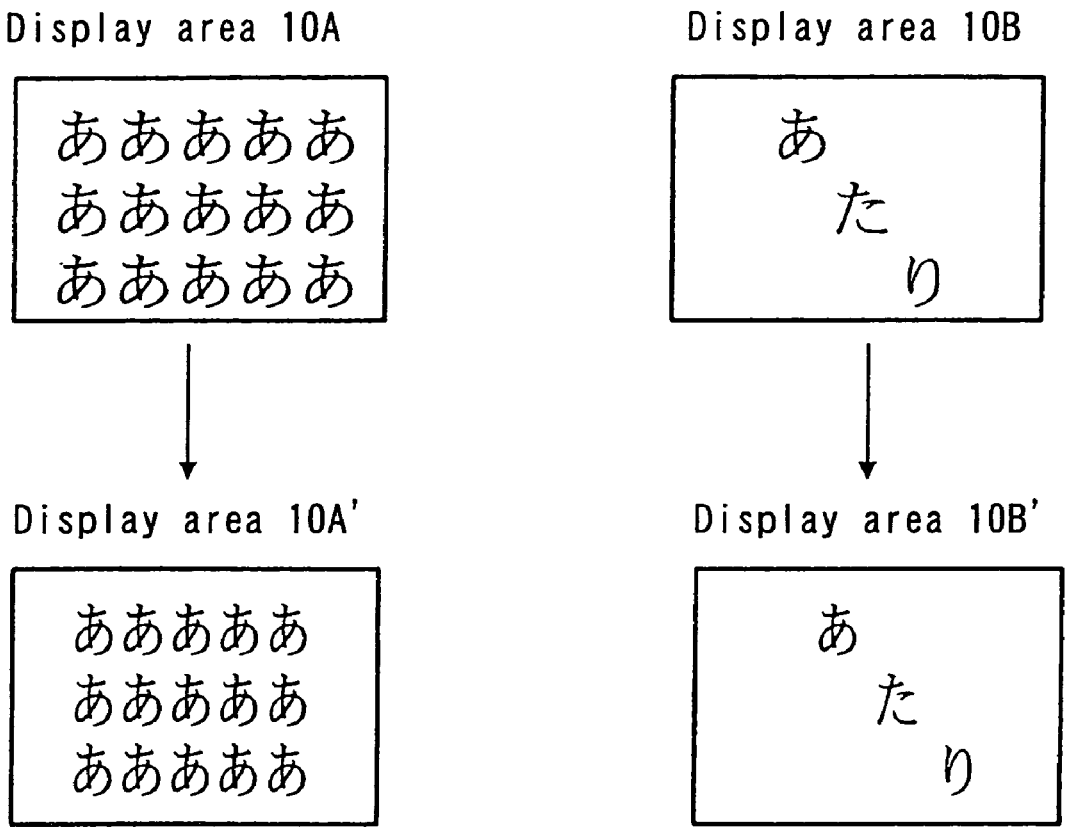
FIG. 10 shows exemplary display areas which display characters having a reduced size.

FIG. 10 shows exemplary display areas which displays characters having a reduced size.

A display area 10A and a display area 10B are display areas before the character size is reduced. A display area 10A' and a display area 10B' are display areas after the character size is reduced. As displayed in the display area 10A', the positions of the characters are kept within the virtual areas since the width of the characters is reduced while the size of the virtual areas is maintained. As displayed in the display area 10B', the positions of the characters are kept within the virtual areas since the width of the characters is reduced while the size of the virtual areas is maintained.

Figure 11:
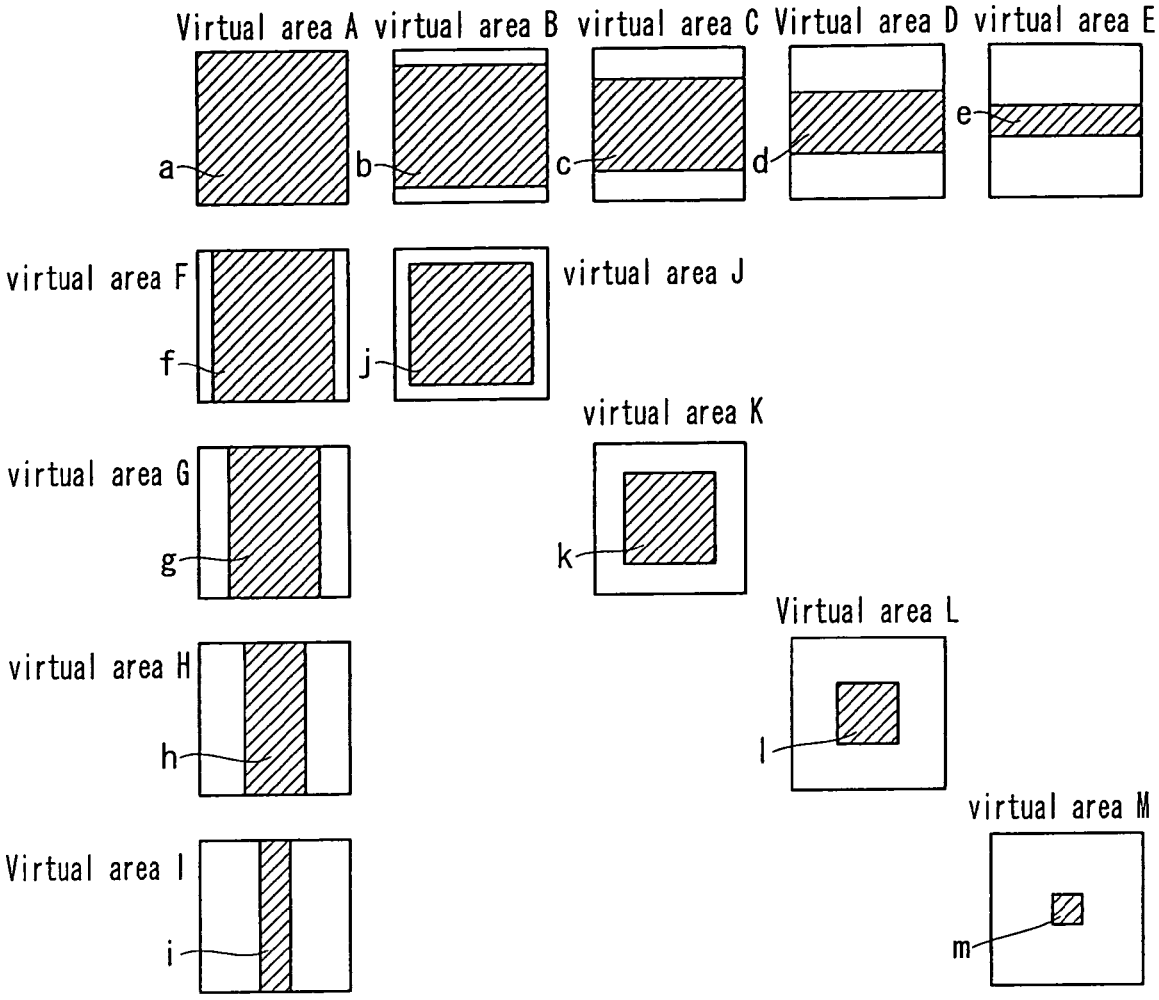
FIG. 11 shows the relationship between the sizes of virtual areas A through M and the sizes of characters a through m.

FIG. 11 shows the relationship between the size of virtual areas A through M and the size of characters a through m displayed in the virtual areas A through M. For example, each of the virtual areas A through M are any one of the virtual areas 430*a* through 430*e* shown in FIG. 1.

It is assumed herein that in the hatched zones in the virtual areas A through M, the characters a through m having the same size as that of the corresponding hatched zone are displayed, respectively.

The virtual areas A through M have all the same size.

In the virtual area A, the character a is displayed. The size of the character a is the same as that of the virtual area A.

In the virtual area B, the character b is displayed. The length of the character b is shorter than the length of the character a. The width of the character b is equal to the width of the character a.

In the virtual area C, the character c is displayed. The length of the character c is shorter than the length of the character b. The width of the character c is equal to the width of the character a.

In the virtual area D, the character d is displayed. The length of the character d is shorter than the length of the character c. The width of the character d is equal to the width of the character a.

In the virtual area E, the character e is displayed. The length of the character e is shorter than the length of the character d. The width of the character e is equal to the width of the character a.

In the virtual area F, the character f is displayed. The length of the character f is equal to the length of the character a. The width of the character f is shorter than the width of the character a.

In the virtual area G, the character g is displayed. The length of the character g is equal to the length of the character a. The width of the character g is shorter than the width of the character f.

In the virtual area H, the character his displayed. The length of the character h is equal to the length of the character a. The width of the character h is shorter than the width of the character g.

In the virtual area I, the character i is displayed. The length of the character i is equal to the length of the character a. The width of the character i is shorter than the width of the character h.

In the virtual area J, the character j is displayed. The length of the character j is equal to the length of the character b. The width of the character j is equal to the width of the character f.

In the virtual area K, the character k is displayed. The length of the character k is equal to the length of the character c. The width of the character k is equal to the width of the character g.

In the virtual area, the character l is displayed. The length of the character l is equal to the length of the character d. The width of the character l is equal to the width of the character h.

In the virtual area M, the character m is displayed. The length of the character m is equal to the length of the character e. The width of the character m is equal to the width of the character l.

FIG. 12 shows exemplary display screens including the virtual areas shown in FIG. 11.

A display screen AA includes the virtual areas A shown in FIG. 11. A display screen FF includes the virtual areas F shown in FIG. 11. A display screen GG includes the virtual areas G shown in FIG. 11. A display screen HH includes the virtual areas H shown in FIG. 11. A display screen II includes the virtual areas I shown in FIG. 11.

FIG. 13 shows exemplary display screens including the virtual areas shown in FIG. 11.

A display screen AA includes the virtual areas A shown in FIG. 11. A display screen BB includes the virtual areas B shown in FIG. 11. A display screen CC includes the virtual areas C shown in FIG. 11. A display screen DD includes the virtual areas D shown in FIG. 11. A display screen EE includes the virtual areas E shown in FIG. 11.

FIG. 14 shows exemplary display screens including the virtual areas shown in FIG. 11.

A display screen AA includes the virtual areas A shown in FIG. 11. A display screen JJ includes the virtual areas J shown in FIG. 11. A display screen KK includes the virtual areas K shown in FIG. 11. A display screen LL includes the virtual areas L shown in FIG. 11. A display screen MM includes the virtual areas M shown in FIG. 11.

For example, in the example shown in FIG. 7, step S102 corresponds to "the step of modifying the size of each of the plurality of characters or graphics while maintaining the size of each of the plurality of virtual areas included in the display area", and step S104 corresponds to "the step of controlling the display device so as to display each of the plurality of characters or graphics having the modified size in the respective virtual area among the plurality of virtual areas". However, the processing procedure of the character display program 141 is not limited to the one shown in FIG. 7. The character display program 141 may have any processing procedure which has the functions of "the step of modifying the size of each of the plurality of characters or graphics while maintaining the size of each of the plurality of virtual areas included in the display area" and "the step of controlling the display device so as to display each of the plurality of characters or graphics having the modified size in the respective virtual area among the plurality of virtual areas".

In the above example, the size of each of the plurality of characters or graphics is modified while the size of each of the plurality of virtual areas included in the display area is maintained, and each of the plurality of characters or graphics having the modified size is displayed in the respective virtual area among the plurality of virtual areas. However, the present invention is not limited to this. The present invention is also applicable to the case where the size of each of a plurality of graphics, instead of, or in addition to, characters while the size of each of the plurality of virtual areas included in the display area is maintained, and then each of the plurality of graphics having the modified size is displayed in the respective virtual area among the plurality of virtual areas. In this case, a graphic display program is usable instead of, or in addition to, the character display program 141. Graphic data is usable instead of, or in addition to, the character data 142. A graphic basic information table is usable instead of, or in addition to, the character basic information table 143. A graphic modification information table is usable instead of, or in addition to, the character modification information table 145. The graphic display program may also include substantially the same steps as those of the character display program 141. A graphic modification program may also include substantially the same steps as those of a character modification program. The graphics may include, for example, part of characters, patterns, and symbols.

According to the present invention, the control section modifies the size of each of a plurality of characters or graphics while maintaining the size of each of a plurality of virtual areas included in a display area, and displays each of the plurality of characters or graphics having the modified size in the respective virtual area.

In this manner, the character/graphic display apparatus according to the present invention modifies the size of each of a plurality of characters or graphics while maintaining the size of each of a plurality of virtual areas. Thus, the size of each of the plurality of characters or graphics is enlarged, or inter-character spaces, spaces between characters and graphics, and inter-graphic spaces are enlarged. As a result, the visual recognizability (ease of reading, or ease of recognition through reading) of characters or graphics is improved.

The character/graphic display apparatus according to the present invention maintains the size of each of the plurality of virtual areas included in a display area. Thus, the position of each of the plurality of virtual areas included in the display area is maintained. Each of the plurality of characters or graphics is displayed in the respective virtual area among the plurality of virtual areas. Therefore, the position at which each of the plurality of characters or graphics is displayed is kept within the respective virtual area among the plurality of virtual areas. Accordingly, the layout of the plurality of characters or graphics is prevented from being changed.

As a result, the visual recognizability (ease of readability, or ease of recognition through reading) of characters or graphics can be improved without changing the layout of the characters or graphics.

Figure 15:
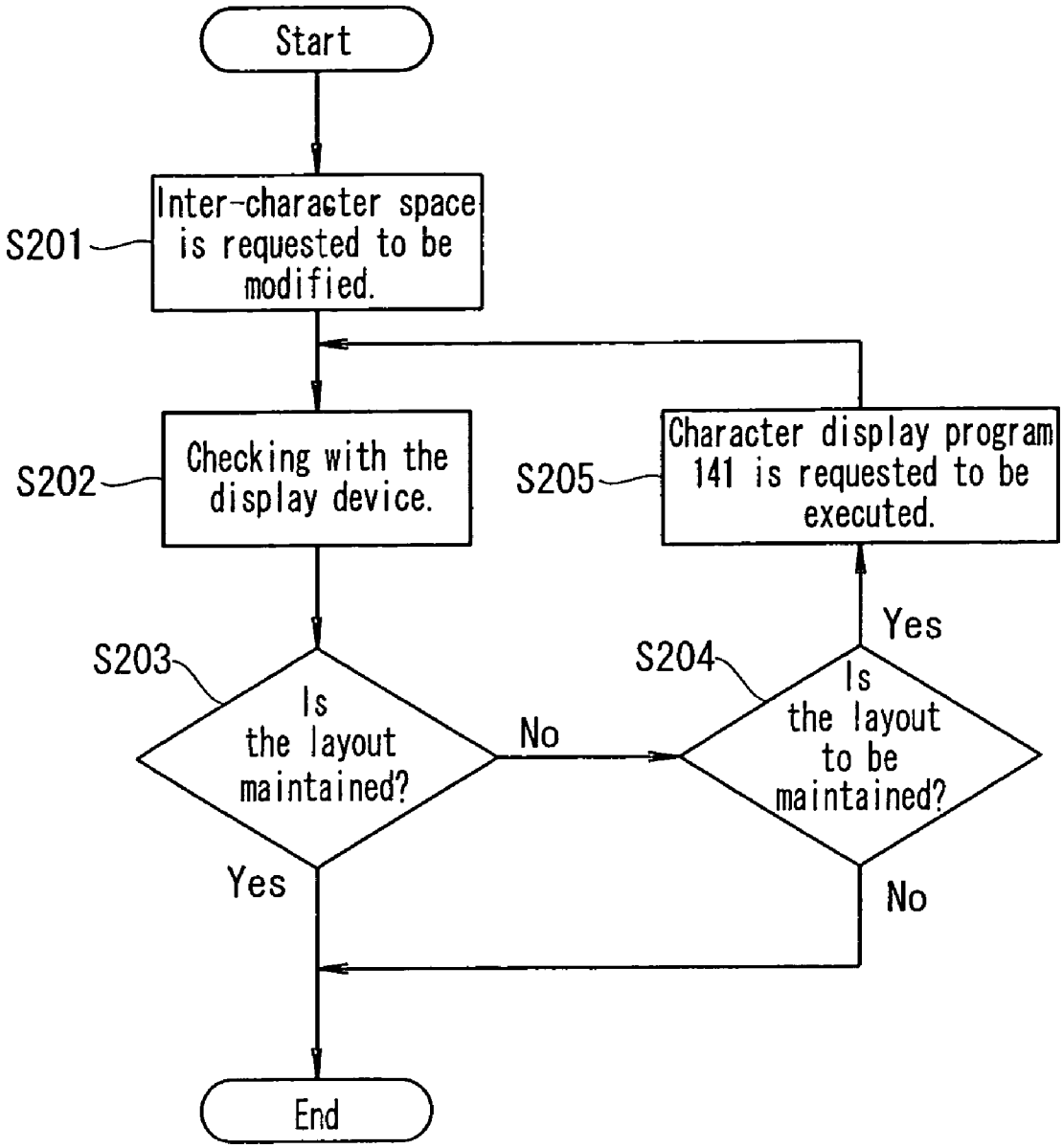
FIG. 15 shows an operation procedure to be followed by the user of the character display apparatus 100 shown in FIG. 3.
Figure 23:
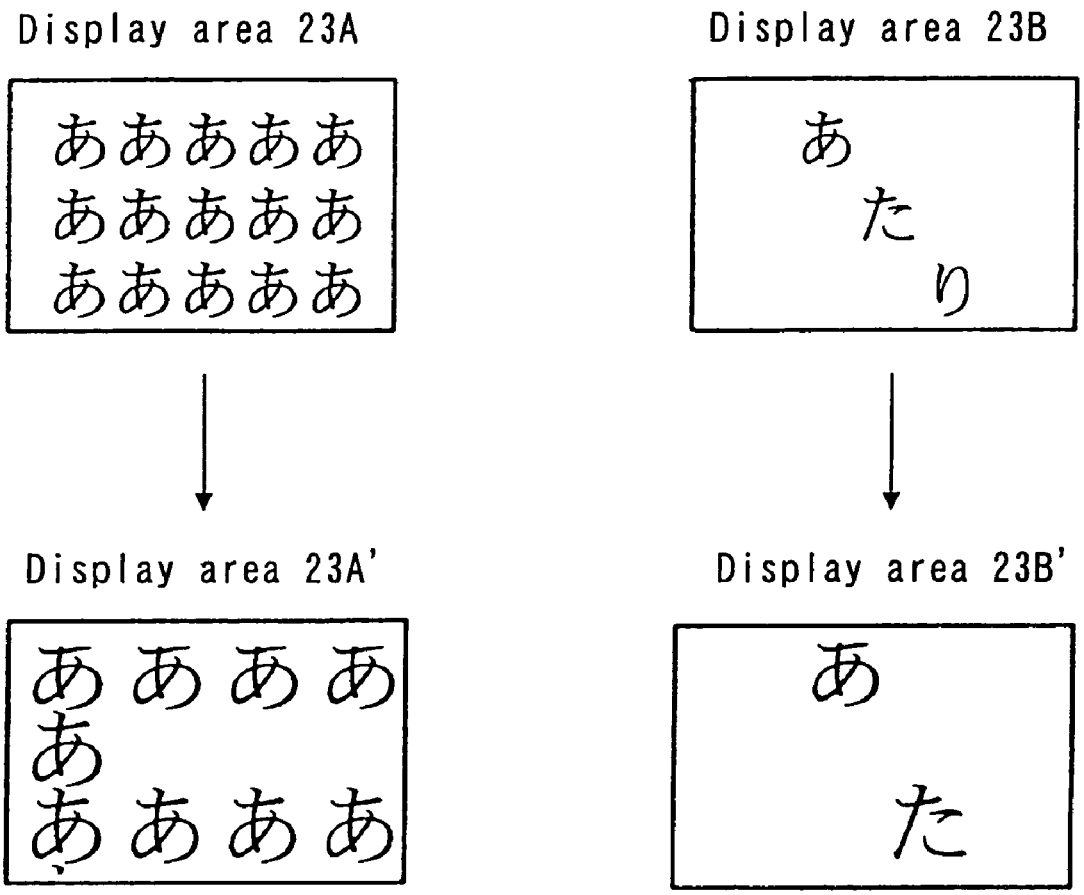
FIG. 23 shows exemplary display areas which display characters, the space between which is enlarged by method (1).
Figure 24:
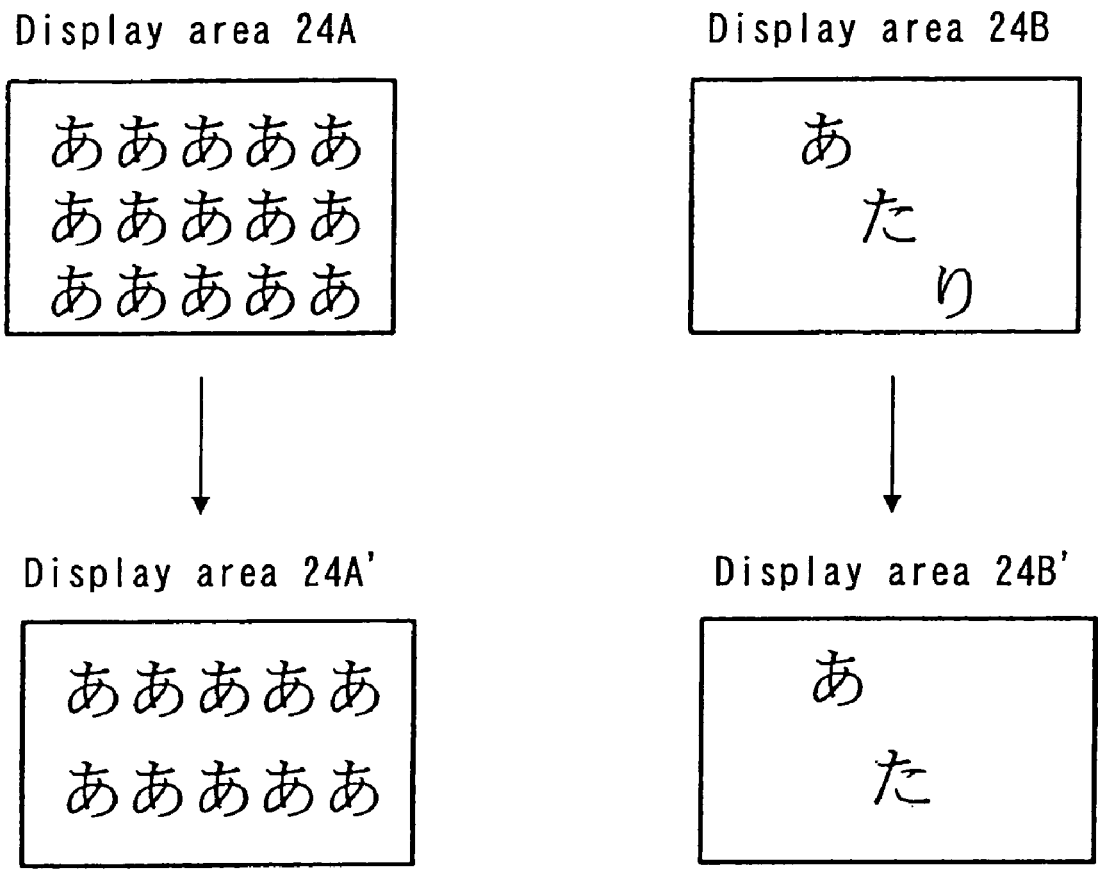
FIG. 24 shows exemplary display areas which display characters, the space between which is enlarged by method (2).
Figure 25:
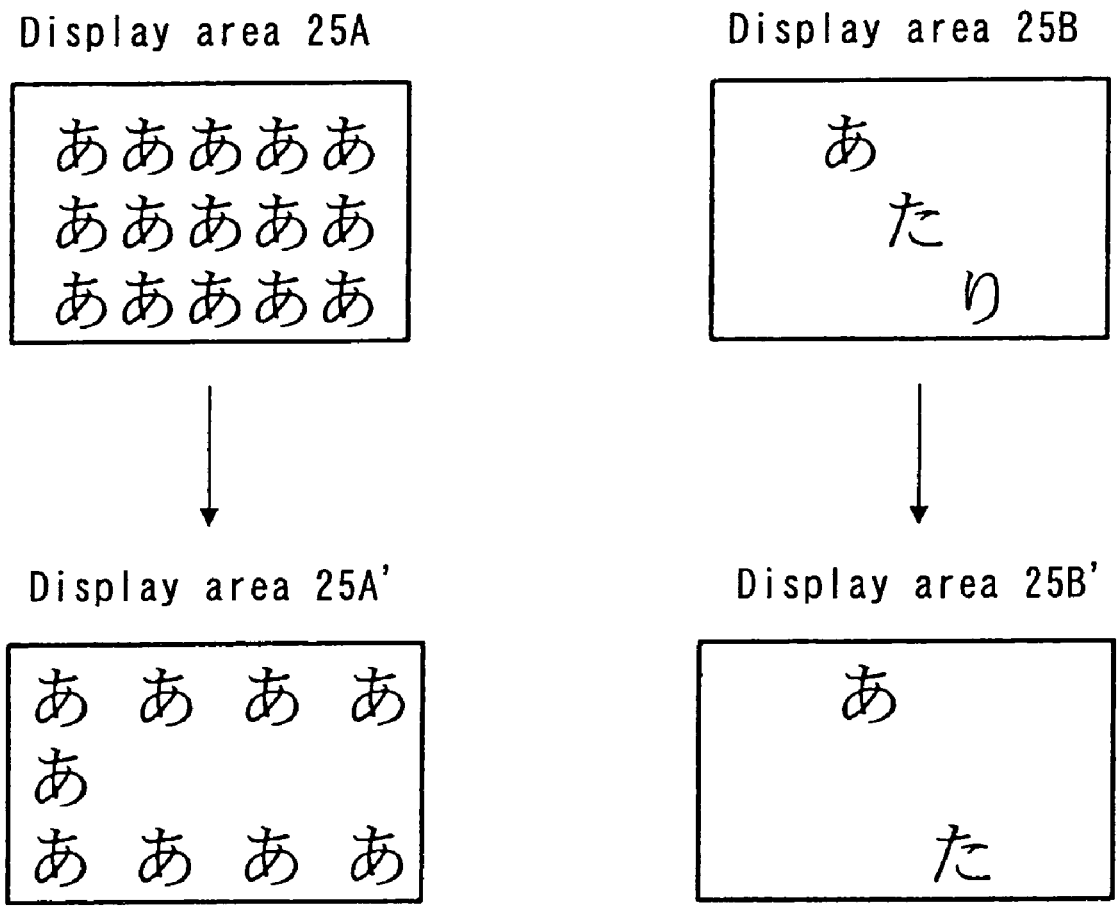
FIG. 25 shows exemplary display areas which display characters, the space between which is enlarged by method (2).
Figure 26:
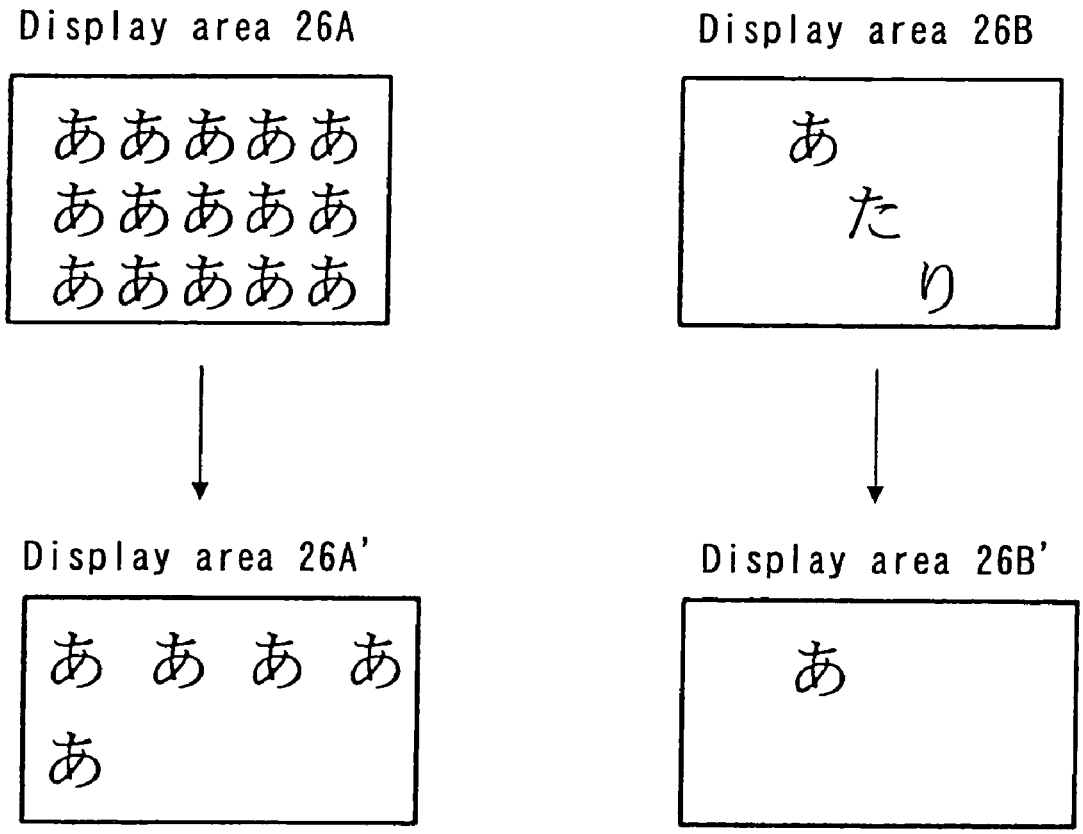
FIG. 26 shows exemplary display areas which display characters, the space between which is enlarged by method (2).

FIG. 15 shows an operation procedure to be followed by the user of the character display apparatus 100 shown in FIG. 3.

Step S201: The user uses the input device 130 to send a signal for modifying the inter-character space to the character display apparatus 100.

FIG. 16 shows a plurality of characters displayed by the display device.

At this point, the plurality of characters displayed by the display device may be a plurality of characters which has been stored in the assisting memory device 140, or a plurality of characters which has been input to the character display apparatus 100 via the input device 130. The plurality of characters stored in the assisting memory device 140 may be, for example, an electronic mail message received by the character display apparatus 100 via a communication line (not shown).

Step S202: The user checks the display screen on which the inter-character space has been modified.

Step S203: The user determines whether or not the layout is maintained.

In step S203, the user may have the CPU 121 determine whether or not the layout is maintained based on the character basic information table 143 and the display screen information table 144.

When "Yes" in step S203, the processing is terminated.

When "No" in step S203, the processing proceeds to step S204.

Step S204: The user determines whether or not the layout is to be maintained.

When "Yes" in step S204, the processing proceeds to step S205.

When "No" in step S204, the processing is terminated.

Step S205: The user uses the input device 130 to send a signal to the character display apparatus 100, the signal being for allowing the control section 120 included in the character display apparatus 100 to execute the character display program 141.

FIG. 17 shows a plurality of characters displayed by the display device after the character display program 141 is executed.

Each of the plurality of characters is displayed on the respective virtual area among the plurality of virtual areas. Therefore, the position at which each of the plurality of characters is displayed is kept within the respective virtual area among the plurality of virtual areas. As a result, the visual recognizability (ease of reading, or ease of recognition through reading) of characters is improved without changing the layout of the characters or graphics.

The present invention has been described by way of preferable examples thereof. It is not intended that the present invention is limited to these examples. It is understood that the scope of the present invention is construed as being only limited by the claims. It is understood that those skilled in the art can work the equivalents of the present invention based on the description of the present invention and the technological common knowledge. The patents, patent applications and documents referred to in this specification are herein incorporated by reference and construed as being specifically described in this specification.

INDUSTRIAL APPLICABILITY

According to the present invention, the control section modifies the size of each of the plurality of characters or graphics while maintaining the size of each of the plurality of virtual areas included in the display area, and displays each of the plurality of characters or graphics having the modified size in the respective virtual area among the plurality of virtual areas.

In this manner, the character/graphic display apparatus according to the present invention modifies the size of each of a plurality of characters or graphics while maintaining the size of each of a plurality of virtual areas. Thus, the size of each of the plurality of characters or graphics is enlarged, or inter-character spaces, spaces between characters and graphics, and inter-graphic spaces are enlarged. As a result, the visual recognizability (ease of reading, or ease of recognition through reading) of characters or graphics is improved.

The character/graphic display apparatus according to the present invention maintains the size of each of the plurality of virtual areas included in the display area. Thus, the position of each of the plurality of virtual areas included in the display area is maintained. Each of the plurality of characters or graphics is displayed in the respective virtual area among the plurality of virtual areas. Therefore, the position at which each of the plurality of characters or graphics is displayed is kept within the respective virtual area among the plurality of virtual areas. Accordingly, the layout of the plurality of characters or graphics is prevented from being changed.

As a result, the visual recognizability (ease of readability, or ease of recognition through reading) of characters or graphics can be improved without changing the layout of the characters or graphics.

The invention claimed is:

1. A character/graphic display apparatus, comprising:

a display device including a display area for displaying a plurality of characters or graphics; and a control section for controlling the display device;

wherein:

the display area includes a plurality of virtual areas, each of the virtual areas contains a character area that is less than or equal to the respective virtual area;

the control section modifies the size of each of the character areas within each of the respective virtual areas included in the display area while maintaining the size of each of the virtual areas so that an inter-character space can be modified without changing the layout of the characters or graphics; and the control section controls the display device, such that each of the plurality of characters or graphics is displayed in the respective modified character area within the virtual area among the plurality of virtual areas.

2. The character/graphic display apparatus according to claim 1, wherein:

the size of each of the plurality of characters or graphics is defined by a length and a width of the respective character area; and the control section modifies the size of each of the plurality of characters or graphics such that at least one of the length and the width is modified.

3. The character/graphic display apparatus according to claim 2, wherein the control section modifies the size of each of the plurality of characters or graphics such that the ratio of the length and the width is maintained.

4. The character/graphic display apparatus according to claim 2, wherein the control section modifies the size of each of the plurality of characters or graphics such that the ratio of the length and the width is changed.

5. The character/graphic display apparatus according to claim 1, wherein:

the display area includes a plurality of pixels;

each of the plurality of pixels is divided into a plurality of sub-pixels; and the control section modifies the size of each of the plurality of characters or graphics sub-pixel by sub-pixel.

6. The character/graphic display apparatus according to claim 1, further comprising a storage section for storing a character/graphic modification information table, wherein:

the character/graphic modification information table includes a plurality of pieces of character/graphic modification information;

each of the plurality of pieces of character/graphic modification information is information for modifying the size of each character area within the respective virtual area;

the control section selects at least one piece of character/graphic modification information from the character/graphic modification information table including the plurality of pieces of character/graphic modification information; and the control section modifies the size of each of the character areas in accordance with the selected at least one piece of character/graphic modification information.

7. The character/graphic display apparatus according to claim 1, wherein the size of each of the character areas is modified according to character/graphic modification information selected by the control section.

8. The character/graphic display apparatus according to claim 7, wherein the character/graphic modification information selected by the control section from a character/graphic modification information table, is stored in a storage unit, and wherein the character/graphic modification information table includes a plurality of pieces of character/graphic modification information.

9. The character/graphic display apparatus according to claim 8, wherein a character/graphic basic information table is updated with modified character/graphic data when the size of each of the plurality of characters or graphics is modified.

10. A character/graphic display method implemented by an information device including a display device for displaying a plurality of characters or graphics by the display device including a display area, wherein the display area includes a plurality of virtual areas, each virtual area including a character area that is less than or equal to the respective virtual area, the character/graphic display method comprising the steps of:

modifying the size of each of the character areas while maintaining the size of each of the plurality of virtual areas included in the display area so that an inter-character space can be modified without changing the layout of the characters or graphics; and controlling the display device so as to display each of the plurality of characters or graphics based on the modified character area in the respective virtual area among the plurality of virtual areas.

11. A recording medium readable by a character/graphic display apparatus, which includes a display device having a display area for displaying a plurality of characters or graphics and also includes a control section for controlling the display device, wherein the display area includes a plurality of virtual areas, each virtual area including a character area that is less than or equal to the respective virtual area, and the recording medium has a program recorded thereon for allowing the control section to execute processing comprising the steps of:

modifying the size of each of the character areas while maintaining the size of each of the plurality of virtual areas included in the display area so that an inter-character space can be modified without changing the layout of the characters or graphics; and controlling the display device so as to display each of the plurality of characters or graphics based on the modified character area in the respective virtual area among the plurality of virtual areas.

* * * * *